US006483397B2

(12) United States Patent
Catoiu

(10) Patent No.: US 6,483,397 B2
(45) Date of Patent: Nov. 19, 2002

(54) TANDEM SIX PORT 3:1 DIVIDER COMBINER

(75) Inventor: Miron Catoiu, Kitchener (CA)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/834,570

(22) Filed: Apr. 12, 2001

(65) Prior Publication Data

US 2002/0149441 A1 Oct. 17, 2002

Related U.S. Application Data

(60) Provisional application No. 60/253,607, filed on Nov. 27, 2000.

(51) Int. Cl.[7] ..... H01P 5/18
(52) U.S. Cl. ..... 333/116; 333/117
(58) Field of Search ..... 333/26, 25, 116, 333/117, 33

(56) References Cited

U.S. PATENT DOCUMENTS

| | | | | | |
|---|---|---|---|---|---|
| 3,846,721 | A | * | 11/1974 | Fritz et al. | 333/26 |
| 5,003,622 | A | * | 3/1991 | Ma et al. | 333/26 |
| 5,006,821 | A | * | 4/1991 | Tam | 333/116 |
| 5,446,425 | A | * | 8/1995 | Banda | 333/116 |
| 5,634,208 | A | * | 5/1997 | Nishikawa et al. | 455/327 |
| 6,278,340 | B1 | * | 8/2001 | Liu | 333/26 |

OTHER PUBLICATIONS

"Multi–port Lattice–type Hybrid Networks", by Takaji Kuroda, Takeshi Usui, and Kazuo Yano. IEEE–GMTT International Microwave Symposium (May 17, 1971), pp. 10–11.

"Planar, Multiport, Quadrature–Like Power Dividers/Combiners", by A. A. M. Saleh. IEEE Trans on MTT, vol. MTT–28 (Jun. 1980) pp. 483–486.

"An N–Way Hybrid Power Divider", E. J. Wilkinson, IRE Trans on MTT, vol. MTT–8 (Jan. 1960) pp. 116–118.

"A New N–Way Power Divider/Combiner Suitable For High Power Applications", U.H. Gysel. 1975 MTTS International Microwave Symposium, pp. 116–118.

(List continued on next page.)

*Primary Examiner*—Robert Pascal
*Assistant Examiner*—Dean Takaoka
(74) *Attorney, Agent, or Firm*—Daly, Crowley & Mofford, LLP

(57) ABSTRACT

A six port 3:1 power divider and combiner. The inventive divider/combiner includes first, second and third weakly coupled transmission lines. The first transmission line provides first and second ports at first and second ends thereof, respectively. The second transmission line provides third and fourth ports at first and second ends thereof, respectively and the third transmission line provides fifth and sixth ports at first and second ends thereof, respectively. In the illustrative embodiment, the first, second and third transmission lines are coupled to provide equal outputs at said second, fourth and sixth ports in response to an application of a signal at the first port. The first second and third conductors may be implemented with coaxial, stripline or microstrip type transmission lines. The looser coupling is very beneficial, especially in microstrip, to obtain high power capability and a manufacturable circuit. In an illustrative 3:1 divider/combiner implementation, the coupling arrangement provides a voltage coupling coefficient x equal to 0.325057. Consequently, the first, second and third coupling lines have a relative coupling value of approximately −10 decibels. In the best mode, the first, second and third coupling lines have a relative coupling value of −9.76 decibels.

52 Claims, 2 Drawing Sheets

OTHER PUBLICATIONS

"A Microwave Power Divider", by R.J. Mohr, IEEE Trans on MTT. (Nov. 1961), p. 573.

"AdrenaLine Inline Splitter/Combiner Networks", Anaren Catalog, vol. 1, 6 pgs.

Microwave Components Catalog (www.anaren.com) (Aug. 1999) 3 pages.

"Analysis and Design of Four–Port and Five–Port Microstrip Disc Circuits", by K.C. Gupta and M.D. Abouzahra, IEEE Trans on MTT., vol. MTT–33, No. 12 (Dec. 1985), pp. 1422–1428.

"Multiple–port Power Divider/Combiner Circuits Using Circular Microstrip Disk Configurations", by M. D. Abouzahra and K. C. Gupta. IEEE Trans on MTT., vol. MTT–35 No. 120 (Dec. 1987), pp. 1296–1302.

"The Design and Performance of Three–Line Microstrip Couplers", by D. Pavlidis and H.L. Hartnagel, IEEE Trans on MTT, vol. MTT–24 No. 10 (Oct. 1976), pp. 631–640.

"Multiport Power Divider–Combiner Circuits Using Circular–Sector–Shaped Planar Components", M.D. Abouzaha and K.C. Gupta. IEEE Trans on MTT., vol. MTT–36, No. 12 (Dec. 1988), pp. 1747–1751.

* cited by examiner

TANDEM SIX PORT 3:1 DIVIDER COMBINER

This application claims the benefit of U.S. Provisional Application No. 60/253,607, filed Nov. 27, 2000, the disclosure of which is hereby incorporated by reference.

BACKGROUND OF THE INVENTION

1. Field of the Invention

The present invention relates to power dividers and combiners. More specifically, the present invention relates to high power, large bandwidth power divider and combiners operating at S-band for driving, C-class amplifiers.

2. Description of the Related Art

Power dividers are used to direct microwave radio frequency (RF) power from one source to two or more outputs. Likewise, power combiners are used to combine power from two or more sources to provide one output. Currently, the most widely used coupler in the RF field is the overlay hybrid four port Coupler. The overlay hybrid four port coupler is a two-way combiner having two inputs, each of which communicates with two outputs. It is an 'overlay' coupler because one or more of the conductors thereof couple energy to an adjacent conductor by physically overlaying the adjacent conductor. The overlay hybrid four port coupler is widely used because it improves the voltage standing wave ratio (VSWR) of a signal notwithstanding, the fact that the inputs may be highly mismatched. N-way combiners are not known to provide such SWR performance.

In binary power dividers and combiners, the inputs are related to the outputs by a power of two. Efficient power combining architectures in high power (e.g. 1 kilowatt (kW) and higher) microwave transmitters require non-binary combining techniques due to the increased power gain of the presently available microwave C-class transistors. (As is well known in the art, microwave C-class bipolar transistors have evolved in the last 6 years from a gain of 7 dB to more than 8.5 dB presently)

For a new RADAR transmitter and other applications, a need has been recognized in the art for a 3:1 hybrid divider/combiner for a non-binary combined 1 kW microwave unit amplifier. Ideally, this coupler will duplicate the performance of the classic 2:1 overlay 90° hybrid coupler and should be easy to integrate in the amplifier's layout. To be used as a combiner in C-class amplifiers. the coupler should have low loss, sufficient bandwidth and good active return loss. It should also be matched at the second harmonic of the operating frequency. When used as a divider, for driving class C transistors, the amplitude imbalance between the output ports of the coupler should be kept to a minimum.

The only known three-way 90° coupler that has hybrid properties and can be implemented in a microstrip layout is the N-way branch coupler. This coupler is a generalized form of the classic two-way branch hybrid coupler. (See "Multi-port Lattice-type Hybrid Network", by Takai Kuroda, Takeshi Usui, and Kazuo Yano, *IEEE-GMTT International Microwave Symposium* (1971) and "Planar Electrically Symmetric N-Way Hybrid Power Dividers/Combiners", by A. A. M. Saleh, *IEEE Trans on MTT.,* vol. MTT-28 (June 1980).) This N-way branch coupler can offer good return loss and isolation over a few percent relative bandwidth only. It is highly reactive at the second harmonic of the operating frequency and has poor active return loss, which is not acceptable for C-class amplifiers.

The Wilkinson three-way divider/combiner has limited power performance and requires a tri-dimensional resistive balancing circuit. That is, the Wilkinson divider/combiner has no equal mismatch canceling, modest isolation, no high power capability and is non-planar (3D). In addition, the fringe fields around the balancing resistors increase the insertion loss. (See "An N-Way Hybrid Power Divider", E. J. Wilkinson, IRE Trans on MTT., vol. MTT-8 (January 1960).)

Good power capability and isolation are offered by the Gysel combiner, but this design does not have the important property of identical mismatch canceling. In addition. the Gysel combiner is mismatched at the second harmonic. Its complex design requires a large printed wiring board (PWB) area. The result is a large, lossy device in microstrip, which is difficult to implement in planar artwork. (See "A New N-Way Power Divider/Combiner Suitable For High Power Applications", U. H. Gysel, 1975 MTT-S International Microwave Symposium.)

The chain combiner can offer good performance but the 3 dB and 4.77 dB overlay couplers required, and the registration requirements thereof, limit the peak power capability and can not be integrated in a microstrip layout. It would also require a special substrate thickness which would be unacceptable in the high power microwave application. (See "A Microwave Power Divider", by R. J. Mohr, *IEEE Trans on MTT.* (November 1961) and "Adrenaline Couplers", *ANAREN RF and Microwave Components Catalog.*

The star divider has not proven to be feasible for this application. Various other (star divider derived) planar geometries have been explored to create a 1:N divider/combiner but the performances obtained are not satisfactory when compared to what is necessary in a microwave C-class amplifier. (See "Analysis and Design of Four-Port and Five-Port Microstrip Disc Circuits", by K. C. Gupta and M. D. Abouzahra, *IEEE Trans on MTT.,* vol. MTT-33, (December 1985); "Multiple-polt Power Divider/Combiner Circuits Using Circular Microstrip Disk Configurations", by M. D. Abouzahra and K. C. Gupta, *IEEE Trans on MTT.,* vol. MTT-35 (December 1987); and "Multiport Power Divider-Combiner Circuits Using Circular-Sector-Shaped Planar Components", M. D. Abouzahra and K. C. Gupta, *IEEE Trans on MTT.,* vol. MTT-36,(December 1988).)

There is a need for a Coupler that is broadband, provides good active return loss and can be implemented on a soft substrate $\in_r \leqq 3$. Ideally, the coupler would have a 3:1 combining/division ratio and should retain all hybrid advantages and properties. There is a further need for a design that is easily manufactured using standard procedures and offers a sufficiently low imbalance and VSWR under expected manufacturing tolerances to be adequate for C-class amplifiers. This will make possible the implementation of the 3:1 coupler directly into the amplifier's layout.

SUMMARY OF THE INVENTION

The need in the art is addressed by the power divider and combiner of the present invention. The inventive divider/combiner includes first, second and third weakly coupled transmission lines. The first transmission line provides first and second ports at first and second ends thereof, respectively. The second transmission line provides third and fourth ports at first and second ends thereof, respectively and the third transmission line provides fifth and sixth ports at first and second ends thereof, respectively.

In the illustrative embodiment, the first, second and third transmission lines are coupled to provide equal outputs at said second, fourth and sixth ports in response to an application of a signal at the first port.

The inventive divider/combiner may be implemented with coaxial, stripline or microstrip type transmission lines. The looser coupling of the present invention is very beneficial, especially in microstrip, to obtain high power capability and a manufacturable circuit. In the illustrative 3:1 divider/combiner implementation, the coupling arrangement provides a voltage coupling coefficient x equal to 0.325057. Consequently, the first, second and third coupling lines have a relative coupling value of approximately −10 decibels. In the best mode, the first, second and third coupling lines have a relative coupling of −9.76 decibels.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
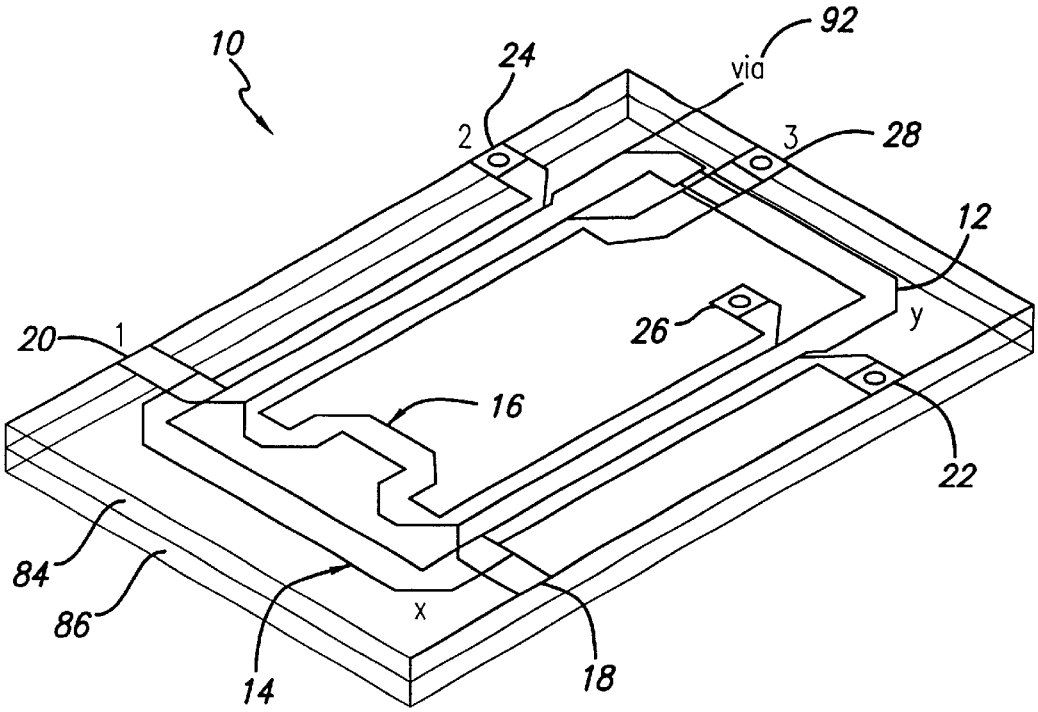
FIG. 1 is a perspective view of an illustrative implementation of the power divider and combiner of the present invention.

FIG. 1 is a perspective view of an illustrative implementation of the power divider and combiner of the present invention. As discussed more fully below, the new 3:1 coupler is formed by connecting in tandem two six port structures (three-line directional couplers, having a much looser coupling than −4.77 dB), interconnected with three equal electrical length, 50 ohm lines. A three-line microstrip coplanar coupler was analyzed in the past by Pavlidis and Hartnagel but no attempt was made to apply this structure to a non-binary hybrid coupler circuit. (See "The Design and Performance of Three-Line Microstrip Couplers", by D. Pavlidis and H. L. Hartnagel, *IEEE Trans on MTT,* vol. MTT-24 (October 1976).)

Figure 2:
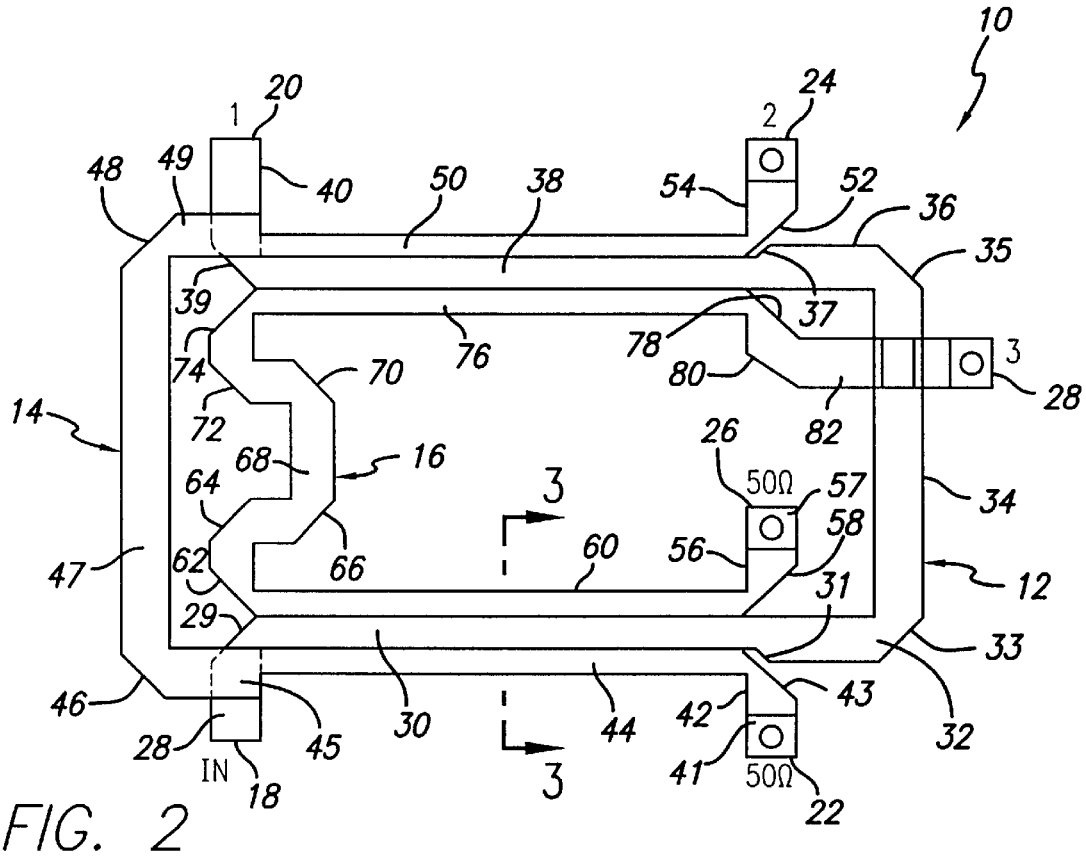
FIG. 2 is a top view of the illustrative implementation of the power divider and combiner of the present invention.

FIG. 2 is a top view of the illustrative implementation of the power divider and combiner of the present invention.

Figure 3:
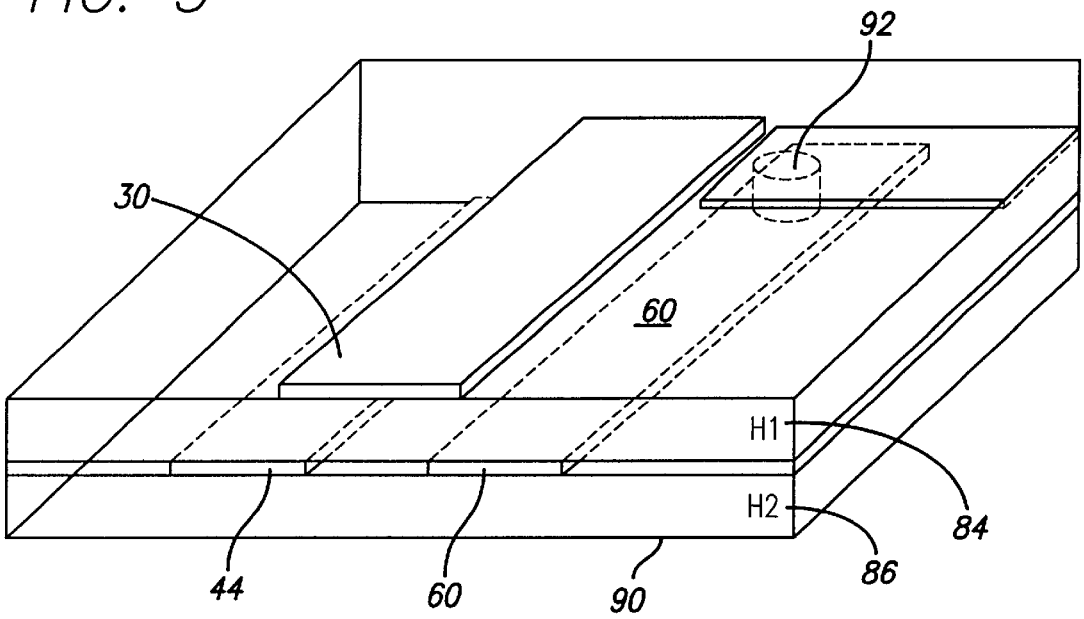
FIG. 3 is a sectional end view of the second sections of the first, second and third lines of the illustrative implementation of the power divider and combiner of the present invention taken along the line 3—3 of FIG. 2.

FIG. 3 is a sectional end view of the second sections of the first, second and third lines of the illustrative implementation of the power divider and combiner of the present invention taken along the line 3—3 of FIG. 2.

Figure 4:
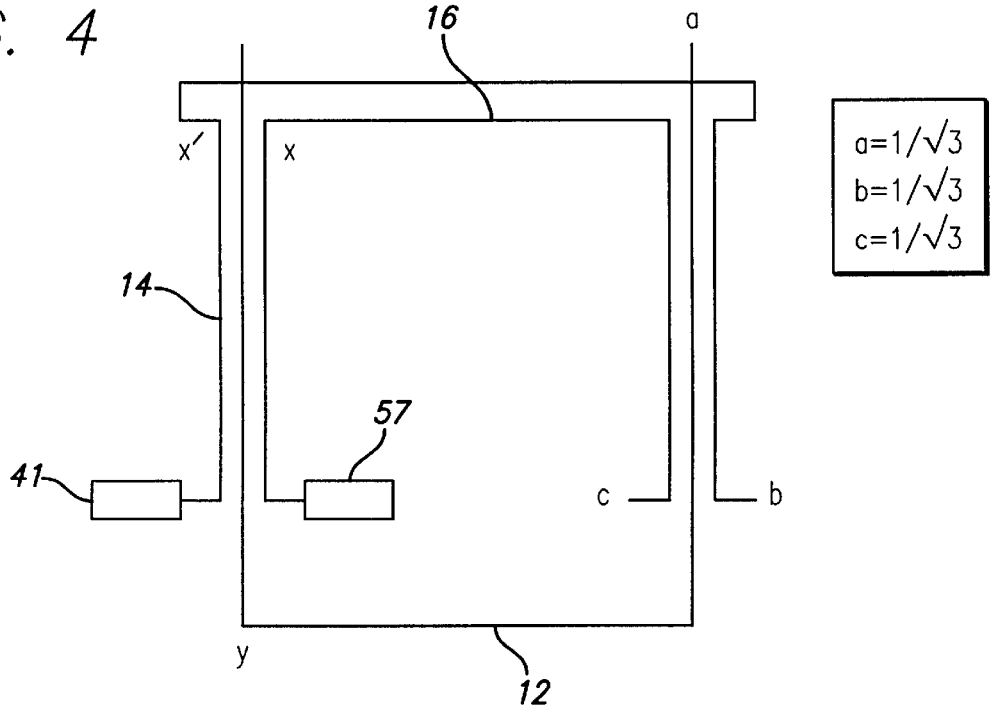
FIG. 4 is a schematic diagram of the illustrative implementation of the power divider and combiner of the present invention.

FIG. 4 is a schematic diagram of the illustrative implementation of the power divider and combiner of the present invention.

The inventive divider/combiner 10 may be implemented with coaxial cable, stripline or microstrip conductors of conventional design and construction. As shown in FIGS. 1, 2 and 4, the inventive divider/combiner 10 includes first, second and third transmission lines 12, 14 and 16, respectively.

As best illustrated in FIG. 2, the first transmission line 12 provides first and second ports at first and second ends 18 and 20 thereof, respectively. The second transmission line 14 provides third and fourth ports at first and second ends 22 and 24 thereof, respectively and the third transmission line 16 provides fifth and sixth ports at first and second ends 26 and 28 thereof, respectively. In the illustrative embodiment, each of the transmission lines has a substantially U-shaped design. The first line 12 has a first section 28 which extends from the first end 18 thereof. The first section 28 joins a second section 30 through a 90° bend 29. The second section has the same width as the first section up to a transition region 31 at which the width of the first section extends to a wider diameter and an output end 32 thereof. The second section 32 engages a third section 34 through a second 90° bend 33. The third section 34 has the same width as the output 32 of the second section 30. The third section 34 engages a fourth section 38 via an input section 36 thereto through a third 90° bend 35. The input section width tapers through region 37 to the more narrow width of the fourth section 38. The width of the fourth section 38 is equal to that of the second section 30. The fourth section is connected to the second end 20 of the first line 12 via an output section 40 through a fourth 90° bend 39. It will be appreciated by those of ordinary skill in the art that any non-terminated port may be considered an input port or an output port because the divider/combiner 10 is a reciprocal device.

The second line 14 has a first section 42 which extends from the first end 22 thereof. The first end of the second line is terminated with a 50 load 41. The first section 42 joins a second section 44 through a 90° bend 43. The second section 44 has the same width as the first section 42 up to a transition region 45 at which the width of the first section extends to a wider diameter and an output end thereof. The second section 44 engages a third section 47 through a second 90° bend 46. The third section 47 has the same width as the transition region 45. The third section 47 engages a fourth section 50 via an input section 49 thereto through a third 90° bend 48. The input section width drops to the more narrow width of the fourth section 50. The width of the fourth section 50 is equal to that of the second section 44. The fourth section 50 is connected to the second end 24 of the second line 14 via an output section 54 through a fourth 90° bend 52.

The third line 16 has a first section 56 at the input end 26 thereof which is terminated with a second 50 ohm load 57. The first section joins a second section 60 via a 90° bend 58. The second section 60 is connected to a third section 68 through a series of 90° bends 62, 64 and 66. The third section connects to a fourth section 76 through a second series of 90° bends 70, 72 and 74. The design of the third section 68 with the input and output bends provides for a net length of the third line 16 equal to that of the second line 14 and 34. The fourth section 76 is connected to an output section 82 via two final 90° bends 78 and 80.

The total length of each line may be determined in accordance with conventional design techniques well known to one of ordinary skill in the art. The width of each line is chosen to provide optimal coupling as discussed more fully below with reference to FIG. 3.

As mentioned above, FIG. 3 is a sectional end view of the second sections of the first, second and third lines of the illustrative implementation of the power divider and combiner of the present invention taken along the line 3—3 of FIG. 2. The fourth sections of each line 38, 50 and 76 are overlaid in the same manner as the second sections of each line as depicted in FIG. 3. Accordingly, the relative relationships of each line are discussed here with respect to the second sections as illustrated in FIG. 3.

As shown in FIG. 3, the second section 30 of the first line 12 is separated from the second sections 44 and 60 of the second and third lines 14 and 16, respectively, by a first layer of dielectric material 84 having a height 'H1'. The second sections 44 and 60 of the second and third lines 14 and 16, respectively, are elevated about a ground plane 90 by a second layer of dielectric material 86 having a height 'H2'.

In accordance with the present teachings, the dimensions of the lines 12, 14 and 16 are designed to enable sufficient coupling to provide equal outputs at the second, fourth and sixth ports in response to an application of a signal at the first port in a power divider mode of operation. That is, in illustrative implementation, the coupling arrangement is designed to provide a voltage coupling coefficient x, between the first line 12 and the second and third lines 14 and 16 of the three-line six port divider 10, (sixport 1 and 2) which will give 3-way equal splitting, when used in tandem equal to 0.325057. Consequently, the first, second and third coupling lines have a relative coupling value of approximately −10 decibels. In the best mode, the first, second and third coupling lines have a relative coupling value of −9.76 decibels. This looser coupling is very beneficial, especially in microstrip, to obtain high power capability and a manufacturable circuit.

The coupling coefficient is computed as follows. Neglecting the length of connecting lines and the losses and considering the circuit voltages in the ideal case, we have:

$$y^2e^{-j180}+2x^2e^{j0}=-1/\sqrt{3} \text{ at the input port} \quad [1]$$

$$xe^{j0}ye^{-j90}+ye^{j90}xe^{j0}=e^{-j90}/\sqrt{3} \text{ at the output port} \quad [2]$$

where 'x' and 'y' are the voltage coupling coefficients.

Equations [1] and [2] become:

$$2x^2-y^2=-1/\sqrt{3} \quad [3]$$

$$-2jxy=-j/\sqrt{3} \quad [4]$$

yielding:

$$y^2=1/12x^2 \quad [5]$$

$$\text{we note } z=x^2 \quad [6]$$

and $$24z^2+12z/\sqrt{3}-1=0 \quad [7]$$

where z is the power coupling coefficient.

This equation has two solutions and we will retain only the positive one because we can not accept negative powers:

$$z=x^2=0.1056624 \quad [8]$$

Coupling =10*Log(z)=−9.76 dB $$x=0.325057$$

and from the power conservation condition: for a lossless device the sum of incident and emergent power must be zero, all ports considered.

$$2x^2+y^2-1=0 \text{ and } y=0.888074.$$

We have obtained a coupling value close to −10 dB.

$$x=0.3250 \; y=0.8880 \text{ and } K=10*\text{Log}(x^2)=-9.76 \text{ dB}$$

where K is the power coupling coefficient expressed in dB

The architecture shown in FIG. 1 will form a 3:1 hybrid coupler, regardless of the type of six port coupler used (coax, stripline, or microstrip). The much looser coupling is very beneficial, especially in microstrip, to obtain high power capability and a manufacturable circuit.

A suitable microwave substrate should be chosen for the desired operating frequency. In an illustrative implementation, copper-clad low loss dielectric is used. The dielectric constant, substrate height and material type should be chosen based on the size constraints of the application according to current microwave design practice. As will be appreciated by those skilled in the art, this is typically a compromise between radiation loss (for the microstrip embodiment), insertion loss, peak power capability and manufacturability issues. In the exemplary embodiment, the dielectric is Teflon with a ceramic powder and dielectric constant $\in_r \approx 3$ such as Rogers 3003. The thicknesses of the dielectric layers are determined to minimize radiation and to maximize power capacity. An acceptable compromise was found to be 0.51 mm. In addition, in the illustrative embodiment, the dielectric layers 84 and 86 are equal in thickness, i.e., H1=H2=0.5 mm.

The length and widths of the lines 12, 14 and 16 and the amount of overlap between the top line and the coupled lines are then computed using an appropriate CAD (computer aided design) simulator such as that sold by APPLIED WAVE RESEARCH, Inc., USA or SONNET SOFTWARE, USA. The width of the lines and the amount of overlap is computed based on the specified −9.76 dB coupling value. The length of the lines is determined by the desired operating frequency.

Implementation of this three-line circuit on a low dielectric substrate using three coplanar microstrip coupled lines will produce a very narrow gap between the conductors (i.e., less than 0.1 mm).

The placement of the middle line on top of the substrate (FIG. 2) is the preferred choice because in this way the parasitic coupling between left and right line is minimized due to much larger width of middle line. Last but not least, some sort of air bridge is necessary for connections between the crossing conductors, a highly undesirable situation. The way to eliminate this problem is to use a symmetrical, planar, overlay structure, such as that shown in FIG. 1 This problem is solved in this case with a simple via 92. Four vias are used to bring all ports on the top microstrip layer. The four vias are shown on FIG. 2 as round circles. The divider/combiner 10 is then constructed and analyzed using the design simulator.

The three 50 ohm lines 45–49, 62–74 and 31–37 which interconnect the two dual directional couplers are chosen to be $\lambda/4$ of the operating frequency.

This architecture can be used with a wide range of dielectric constants and substrate thicknesses.

A new 3:1 hybrid coupler 10, fit for microwave C-class amplifiers power combining/dividing, has been described and implemented. Those skilled in the art will appreciate that the tandem geometry of the inventive divider/combiner 10 allows for 3:1 or 1:3 operation with weakly coupled lines. The inventive 3:1 coupler 10 has the unique property of retaining the classic 2:1 hybrid coupler advantages and properties including equal mismatch rejection and the ease of manufacturability. The coupler 10 may be manufactured on a soft dielectric substrate (e.g., Rogers 3003). The result is a three-layer circuit with equal substrate height (H1=H2). Due to the way the two six ports are connected, the coupler 10 has low sensitivity to registration error. In the preferred embodiment, the two 50 ohm loads required at ports 22 and 26 are external and connected to ground. Consequently, the 3:1 coupler 10 has high power capability. The coupler 10 and the two 50 ohm loads 41 and 57 occupy less than one square inch substrate area at S-band (on Rogers 3003). Also, due to the increased distance between the overlaid coupled lines, the peak power capability is no longer limited by the substrate thickness.

Then in response to an input signal, the outputs at the three output ports will be equal. Two of the outputs will be in phase and the third will be −90° out of phase. The inventive divider may be implemented as a compact MIC (microwave integrated circuit) structure.

When this type of combiner is also used as a divider, in a balanced amplifier embodiment, the user should be aware that an additional transmission line having an electrical length of 90 degrees is required between the two middle ports (24). This is necessary to ensure the correct phase relationship of the summed (combined) signals.

Thus, the present invention has been described herein with reference to a particular embodiment for a particular application. Those having ordinary skill in the art and access to the present teachings will recognize additional modifications applications and embodiments within the scope thereof. For example, the invention is not limited to the type of transmission lines or materials used in the illustrative embodiment for the conductors and the dielectric nor the dimensions set forth herein.

It is therefore intended by the appended claims to cover any and all such applications, modifications and embodiments within the scope of the present invention.

Accordingly,

What is claimed is:

1. A power divider and combiner comprising:

a first substantially U-shaped transmission line having first and second ports at first and second ends thereof, respectively and having a second section coupled to a third section through a first 90° bend, and a fourth section coupled to said third section through a second 90° bend;

a second transmission line having third and fourth ports at first and second ends thereof, respectively and having second and fourth sections;

a third transmission line providing fifth and sixth ports at first and second ends thereof, respectively and having second and fourth sections; and means for weakly coupling electromagnetic energy between said second section of said first transmission line and said second section of said second transmission line, said second section of said first transmission line and said second section of said third transmission line, said fourth section of said first transmission line and said fourth section of said second transmission line, and said fourth section of said first transmission line and said fourth section of said third transmission line.

2. The power divider and combiner of claim 1 wherein said means for weakly coupling includes means for coupling energy to provide equal outputs at said second, fourth and sixth ports in response to an application of a signal at said first port.

3. The power divider and combiner of claim 2 wherein said means for coupling energy provides a voltage coupling coefficient x equal to 0.325057.

4. The power divider and combiner of claim 3 wherein said first, second and third transmission lines have a relative coupling value of approximately −10 decibels.

5. The power divider and combiner of claim 4 wherein said first, second and third transmission lines have a relative coupling value of −9.76 decibels.

6. The power divider and combiner of claim 1 wherein said first line at least partially overlays said second and said third lines.

7. The power divider and combiner of claim 6 wherein said first line is separated from said. second and said third lines by a first dielectric layer.

8. The power divider and combiner of claim 7 wherein said second and said third lines are separated from a ground plane by a second dielectric layer.

9. The power divider and combiner of claim 8 wherein the thickness of said first dielectric layer is equal to the thickness of the second dielectric layer.

10. The power divider and combiner of claim 1 wherein said first port is an input port.

11. The power divider and combiner of claim 10 wherein said second port is a first output port.

12. The power divider and combiner of claim 11 wherein said fourth port is a second output port.

13. The power divider and combiner of claim 12 wherein said sixth port is a third output port.

14. The power divider and combiner of claim 13 wherein said third port is terminated.

15. The power divider and combiner of claim 14 wherein said fifth port is terminated.

16. The power divider and combiner of claim 15 wherein said third and fifth ports are terminated with 50 ohm loads.

17. The power divider and combiner of claim 1 wherein said first port is an output port.

18. The power divider and combiner of claim 17 wherein said second port is a first input port.

19. The power divider and combiner of claim 18 wherein said fourth port is a second input port.

20. The power divider and combiner of claim 19 wherein said sixth port is a third input port.

21. The power divider and combiner of claim 20 wherein said third port is terminated.

22. The power divider and combiner of claim 21 wherein said fifth port is terminated.

23. The power divider and combiner of claim 22 wherein said third and fifth ports are terminated with 50 ohm loads.

24. A six port 3:1 power divider and combiner comprising:

a first substantially U-shaped transmission line having first and second ports at first and second ends thereof, respectively and having a second section coupled to a first end of a third section through a first 90° bend, and a fourth section coupled to said third section through a second 90° bend;

a second transmission line having third and fourth ports at first and second ends thereof, respectively and having second and fourth sections; and a third transmission line having fifth and sixth ports at first and second ends thereof, respectively and having second and fourth sections;

said first, second and third transmission lines being arranged to weakly couple electromagnetic energy between said second section of said first transmission line and said second section of said second transmission line, said second section of said first transmission line and said second section of said third transmission line, said fourth section of said first transmission line and said fourth section of said second transmission line, and said fourth section of said first transmission line and said fourth section of said third transmission line to provide equal outputs at said second, fourth and sixth ports in response to an application of a signal at said first port.

25. The six port 3:1 power divider and combiner of claim 24 said first, second and third transmission lines being arranged to provide a voltage coupling coefficient x equal to 0.325057.

26. The six port 3:1 power divider and combiner of claim 25 wherein said first, second and third transmission lines have a relative coupling value of approximately −10 decibels.

27. The six port 3:1 power divider and combiner of claim 28 wherein said first, second and third transmission lines have a relative coupling value of −9.76 decibels.

28. The six port 3:1 power divider and combiner of claim 25 wherein said first line at least partially overlays said second and said third lines.

29. The six port 3:1 power divider and combiner of claim 25 wherein said first line is separated from said second and said third lines by a first dielectric layer.

30. The six port 3:1 power divider and combiner of claim 29 wherein said second and said third lines are separated from a ground plane by a second dielectric layer.

31. The six port 3:1 power divider and combiner of claim 30 wherein the thickness of said first dielectric layer is equal to the thickness of the second dielectric layer.

32. The six port 3:1 power divider and combiner of claim 24 wherein said first port is an input port.

33. The six port 3:1 power divider and combiner of claim 32 wherein said second port is a first output port.

34. The six port 3:1 power divider and combiner of claim 33 wherein said fourth port is a second output port.

35. The six port 3:1 power divider and combiner of claim 34 wherein said sixth port is a third output port.

36. The six port 3:1 power divider and combiner of claim 35 wherein said third port is terminated.

37. The six port 3:1 power divider and combiner of claim 36 wherein said fifth port is terminated.

38. The six port 3:1 power divider and combiner of claim 37 wherein said third and fifth ports are terminated with 50 ohm loads.

39. The six port 3:1 power divider and combiner of claim 24 wherein said first port is an output port.

40. The six port 3:1 power divider and combiner of claim 39 wherein said second port is a first input port.

41. The six port 3:1 power divider and combiner of claim 40 wherein said fourth port is a second input port.

42. The six port 3:1 power divider and combiner of claim 41 wherein said sixth port is a third input port.

43. The six port 3:1 power divider and combiner of claim 42 wherein said third port is terminated.

44. The six port 3:1 power divider and combiner of claim 43 wherein said fifth port is terminated.

45. The six port 3:1 power divider and combiner of claim 44 wherein said third and fifth ports are terminated with 50 ohm loads.

46. A method for dividing and combining electromagnetic energy including the steps of:

providing a first substantially U-shaped transmission line having first and second ports at first and second ends thereof, respectively and having a second section coupled to third section through a first 90° bend, and a fourth section coupled to the third section through a second 90° bend;

providing a second transmission line comprising a second section, a fourth section and third and fourth ports at first and second ends thereof;

providing a third transmission line comprising a second section, a fourth section and fifth and sixth ports at first and second ends thereof;

providing a first dielectric layer disposed between second section of the first transmission line and the second section of the second transmission line;

providing a second dielectric layer disposed adjacent the second section of the second transmission line wherein the second section of the second transmission line is disposed between the second dielectric layer and the first dielectric layer;

providing a ground plane disposed adjacent the second dielectric layer wherein the second dielectric layer is disposed between the ground plane and the second section of the second transmission line; and weakly coupling electromagnetic energy between the second section of the first transmission line and the second section of the second transmission line, the second section of the first transmission line and the second section of the third transmission line, the fourth section of the first transmission line and the fourth section of the second transmission line, and the fourth section of the first transmission line and the fourth section of the third transmission line.

47. A device comprising:

a first six port dual directional coupler having:

a first transmission line having an input port at a first end thereof;

a second transmission line, weakly electromagnetically coupled to the first transmission line;

a third transmission line, weakly electromagnetically coupled to the first transmission line;

a second dual directional coupler having:

a first transmission line having a first output port at a first end thereof;

a second transmission line, having a second output port at a first end thereof and weakly electromagnetically coupled to the first transmission line;

a third transmission line, having a third output port at a first end thereof and weakly electromagnetically coupled to the first transmission line; and wherein the first dual directional coupler is coupled in tandem with the second dual directional coupler to provide a 3:1 hybrid coupler.

48. The device of claim 47 further comprising:

three interconnecting lines, wherein said interconnecting lines electrically couple corresponding transmission lines of the first dual directional coupler and the second dual directional coupler; and wherein said interconnecting lines have approximately equal electrical lengths.

49. The device of claim 48 wherein each of the three interconnecting lines, has a length of approximately $\lambda/4$, wherein $\lambda$ is the operating frequency of the device.

50. The device of claim 48 wherein each of the three interconnecting lines comprises a 50 ohm line.

51. The device of claim 47 further comprising:

a first 50 ohm load coupled to a second end of the second transmission line of the second dual directional coupler; and a second 50 ohm load coupled to a second end of the third transmission line of the second dual directional coupler.

52. The device of claim 47 wherein the transmission lines of the first dual directional coupler and the transmission lines of the second dual directional coupler are spaced apart to minimize a parasitic coupling between the first and second dual directional couplers.

* * * * *

UNITED STATES PATENT AND TRADEMARK OFFICE

CERTIFICATE OF CORRECTION

PATENT NO. : 6,483,397 B2
DATED : November 19, 2002
INVENTOR(S) : Catoiu

It is certified that error appears in the above-identified patent and that said Letters Patent is hereby corrected as shown below:

Column 1,
Line 11, delete “power divider” and replace with -- power dividers --.
Line 19, delete “Coupler” and replace with -- coupler --.
Line 26, delete “notwithstanding,” and replace with -- notwithstanding --.
Line 38, delete “presently)” and replace with -- presently) --.
Line 55, delete “by Takai” and replace with -- by Takaji --.

Column 2,
Line 36, delete “Multiple-polt” and replace with -- Multiple-port --.
Line 42, delete “a Coupler” and replace with -- a coupler --.

Column 6,
Line 4, delete “dB” and replace with -- dB. --.

Column 7,
Lines 25-26, delete “modifications applications” and replace with -- modifications, applications --.

Column 8,
Line 8, delete “from said.” and replace with -- from said --.

Signed and Sealed this

Fourth Day of March, 2003

JAMES E. ROGAN
*Director of the United States Patent and Trademark Office*